US005502349A

United States Patent [19]

Seo

[11] Patent Number: 5,502,349

[45] Date of Patent: Mar. 26, 1996

[54] ELASTIC MEMBER FOR SUPPORTING SHADOW MASK OF COLOR PICTURE TUBE

[75] Inventor: Ho S. Seo, Taegu, Rep. of Korea

[73] Assignee: Goldstar Co., Ltd., Seoul, Rep. of Korea

[21] Appl. No.: 267,769

[22] Filed: Jul. 5, 1994

[30] Foreign Application Priority Data

Jul. 5, 1993 [KR] Rep. of Korea ..... 1993-12554

[51] Int. Cl.[6] ..... H01J 29/07

[52] U.S. Cl. ..... 313/404; 313/402; 313/407

[58] Field of Search ..... 313/402, 404, 313/405, 406, 407

[56] References Cited

U.S. PATENT DOCUMENTS

| | | | |
|---|---|---|---|
| 3,671,794 | 6/1972 | Nakamura et al. | 313/404 |
| 4,659,959 | 4/1987 | Fonda | 313/407 |
| 4,678,963 | 7/1987 | Fonda | 313/405 |
| 4,798,992 | 1/1989 | Ichigaya et al. | 313/406 |
| 4,827,180 | 5/1989 | Sone et al. | 313/404 |
| 4,950,943 | 8/1990 | Ito | 313/404 |
| 5,012,154 | 4/1991 | Ragland, Jr. | 313/406 |
| 5,072,151 | 12/1991 | Spina | 313/407 |
| 5,103,132 | 4/1992 | Van Der Bolt et al. | 313/402 |
| 5,347,195 | 9/1994 | Seo | 313/404 |

*Primary Examiner*—Sandra L. O'Shea
*Assistant Examiner*—Vip Patel

[57] ABSTRACT

An elastic member for supporting the shadow mask of a color picture tube comprises a fixing portion having a welding point which is moved from the bottom end to the center or closer to the top end thereof, so that the fixing portion is fixed to the frame of the color picture at the welding point, a sliding portion and a connecting portion to be attached to the panel pin of a face panel through a connecting hole.

6 Claims, 2 Drawing Sheets

ELASTIC MEMBER FOR SUPPORTING SHADOW MASK OF COLOR PICTURE TUBE

BACKGROUND OF THE INVENTION

The present invention relates to a fixing elastic member for supporting shadow mask of a color picture tube. Particularly, it relates to the elastic member with reduced permanent plastic deformation of elastic member caused by repetitive work of removal and attachment of the shadow mask from the color picture tube.

In the conventional color picture tube referring to FIG. 1, electron beams emitted from electron gun 5 of neck 3 and selected by shadow mask 6 are guided to radiate red, green and blue lights, emitting phosphor components of a luminescent screen formed inside of panel 1.

Only 20% of the electron beam is to pass through the shadow mask 6 and the remaining 80% will be absorbed by it. Due to this absorbed beam, the shadow mask 6 is expanded. This causes a change of distance between shadow mask 6 and panel 1, which results in the degrading of color purity. It is, however, to note that in this stage elastic member 8 is used to prevent the degrading of color purity resulted from the change of position. In other words, in a situation where a position change has occurred according to shadow mask's heat expansion by the electron beam emanated from electron gun 5, the elastic member 8 allows the shadow mask 6 to move from the position 9 to 9(*a*) toward the panel 1 in order to prevent degrading of color purity.

In the conventional elastic member design referring to FIG. 4, the welding point A of fixing portion 80 is located at ¾ (three quarters) of fixing portion's length from top end 80*a* thereof where the plastic deformation of elastic member 8 occurs so often as the excessive force over the elasticity limit is applied to elastic member 8, due to the repetitive work of launching the shadow mask 6 to color picture tube. Moreover, the color purity is degraded when a member among several elastic members is deformed more than others, which causes the shadow mask deviation from a prearranged position.

As shown in FIGS. 2 through 4, the conventional elastic member comprises fixing portion 80 welded at the welding point A to mask frame 7 supporting shadow mask 6, a connecting portion 81 having a connecting hole 81*a* attached through panel pin 1*a* formed interior of the panel land a sliding portion 82 by which the fixing portion 80 and the connecting portion 81 form a one piece.

In this regard, the moving distance of shadow mask 6 moved toward panel 1 by elastic member 8 is the same as the length of sliding portion 82. Further it relates to the horizontal distance between fixing portion 80 and panel pin 1*a*.

Generally, in case of shadow mask using invar shadow mask with non-frame, the length of fixing portion is less than 5 mm, that of sliding portion is approximately 16 mm and that of connecting portion is around 18.5 mm, while the thickness of it is about 0.76 mm. With reference to FIG. 4, the welding point A of fixing portion 80 welded to mask frame 7 is located at three quarters of fixing portion's length from top end 80*a* thereof. And elastic member 8 has the limitation of transferring the shadow mask 6 to a certain distance toward panel 1. As a result, the length of sliding portion 82 has to be decided within a fixed range.

On the other hand, elastic member of second embodiment as shown in FIG. 5 comprises two pieces of the conventional elastic member shown in FIG. 4, welded symmetrically with each other so that it forms one elastic member.

Furthermore, the connecting portion 812 without any connecting hole is welded to mask frame 7 whereas the other connecting portion 81 with connecting hole 81*a* is attached through panel pin 1*a*. The sliding portion 811 connects the second fixing portion 813 and the connecting portion 812.

This type of elastic member, like one-piece elastic member, has a function of transferring shadow mask 6 toward panel 1 in order to prevent the degrading of color purity.

When the distance between the shadow mask and the panel changes due to heat expansion of the shadow mask; the problem of one-piece still applies to the two-piece elastic member because of the fact that the welding point A for fixing portion 80 and second fixing portion 813 is still located at three quarters of fixing portion's length from top end 80*a* thereof.

SUMMARY OF THE INVENTION

It is an object of the present invention is to provide an elastic member for supporting shadow mask of a color picture tube to decrease permanent plastic deformation of the elastic member resulted from the repetitive work of shadow mask removal from color picture tube. In order to achieve aforementioned objects, a welding point of fixing portion, which is attached to a mask frame, is disposed at less than one half (½) distance of fixing portion's length, which is in between the center of fixing portion and top end thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and, thus, are not limitative of the present invention, and wherein.

DETAILED DESCRIPTION OF THE PREFERRED EMBODIMENTS

The elastic member according to the present invention is described in detail by preferred embodiments of accompanying drawings.

The elastic member according to the present invention is an elastic body comprising a fixing portion, a connecting portion and a sliding portion. The fixing portion is a portion welded into the mask frame which supports the shadow mask in a certain position and the connecting portion includes a connecting hole through which the fixing portion is attached to the panel pin disposed on the inner side of panel. The sliding portion connects the fixing portion and the connecting portion, forming a one-piece elastic member.

The elastic member according to the present invention relates to the embodiment in which welding point is changed from three quarters of fixing portion's length from top end thereof to less than one half (½) of the same length from top end thereof. This elastic member is for decreasing the degrading of color purity resulted from the position change due to the heat expansion of shadow mask.

Figure 1:
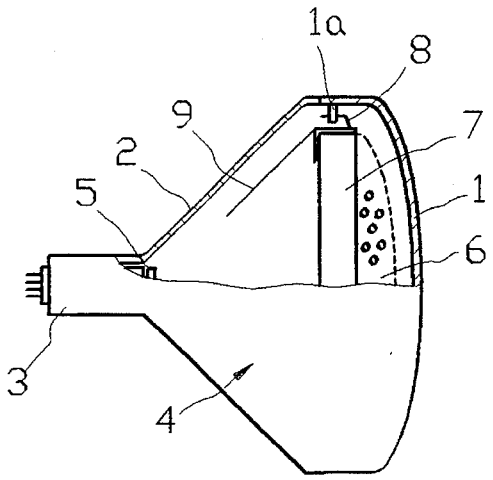
FIG. 1 is a partial, side sectional view showing the structure of a color picture tube.
Figure 2:
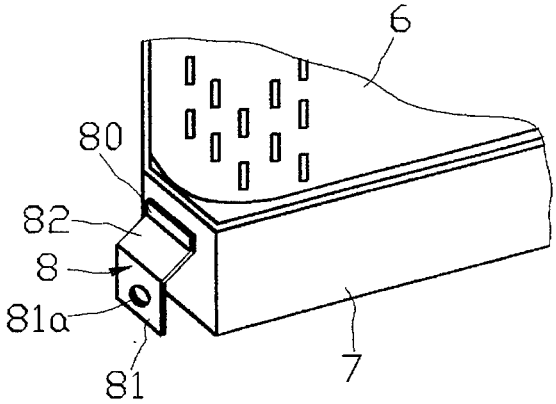
FIG. 2 is a partial perspective view showing the attached position of an elastic member.
Figure 3:
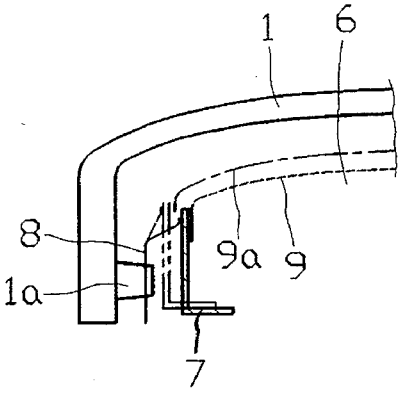
FIG. 3 is an enlarged fragmentary sectional view showing the position change an of elastic member.
Figure 4:
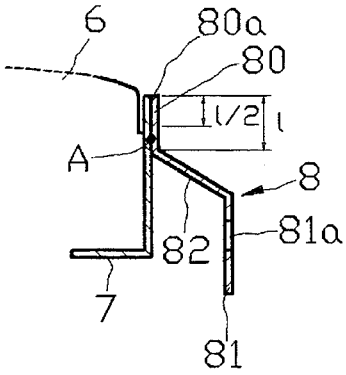
FIG.4 PRIOR ART
FIG. 4 is a partially enlarged, fragmentary sectional view showing a conventionally welded elastic member to a mask frame.
Figure 5:
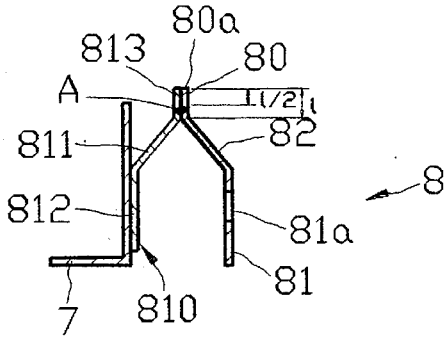
FIG.5 PRIOR ART
FIG. 5 is a partially enlarged fragmentary sectional view of other type of elastic member according to the prior art.
Figure 6:
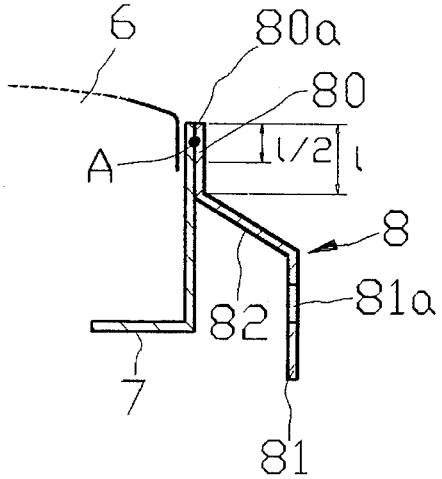
FIG. 6 is a partially enlarged fragmentary sectional view of a welded elastic member according to the present invention.

In the preferred embodiment of the present invention as shown in FIG. 6, the fixing portion is directly welded into the mask frame 7 which supports the shadow mask. Without departing from the scope of the present invention, an elastic member having the fixing portion with 5 mm length, 16 mm long connecting portion, approximately 18.5 mm long sliding portion and 0.76 mm thickness can be used. It is preferable to use the stainless steel as substance for elastic member.

In aforementioned embodiment, because a welding point A of fixing portion 80 attached to mask frame 7 is located at less than one half (½) of the length from top end 80*a* thereof, an extended portion which is the portion from welding point A to the bottom end of fixing portion contributes to the reduction of the permanent plastic deformation of elastic member when the excessive force is applied.

Accordingly, without changing the size of the elastic member, the present invention decreases the permanent plastic deformation of the elastic member because of the fact that sliding portion is substantially elongated by the length from the welding point A to the bottom end of fixing portion.

Figure 8:
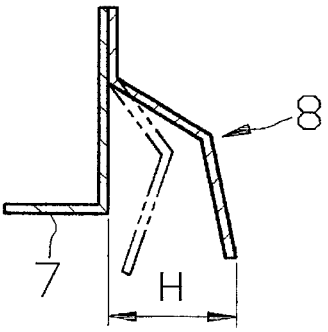
FIG. 8 is a partially enlarged, fragmentary sectional view showing a repetitive displacement test.
Figure 9:
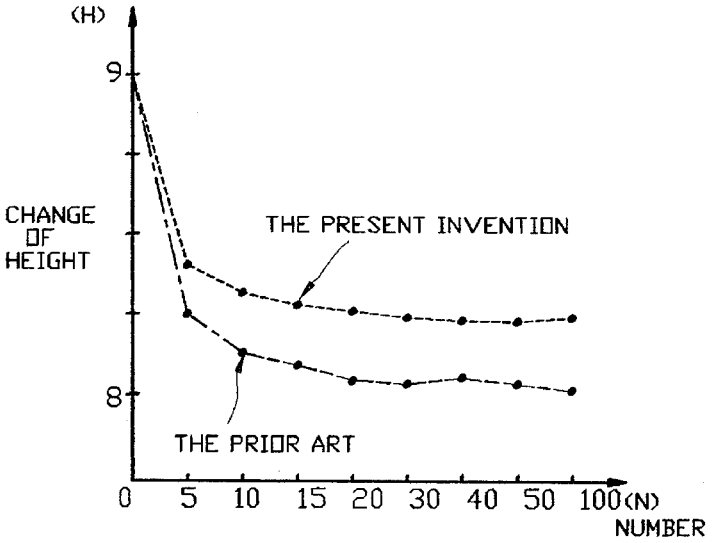
FIG. 9 is a graph of displacement quantity of the conventional elastic member compared with that of the present invention.

FIGS. 8 and 9 show the displacement test method and its comparison data of the conventional elastic member's displacement quantity and that of the present invention.

To know the variation of horizontal distance between fixing portion, and connecting portion several repetitive tests were conducted.

The result shows that plastic deformation of the elastic member according to the present invention is reduced by moving the welding point toward the top end of fixing portion.

Figure 7:
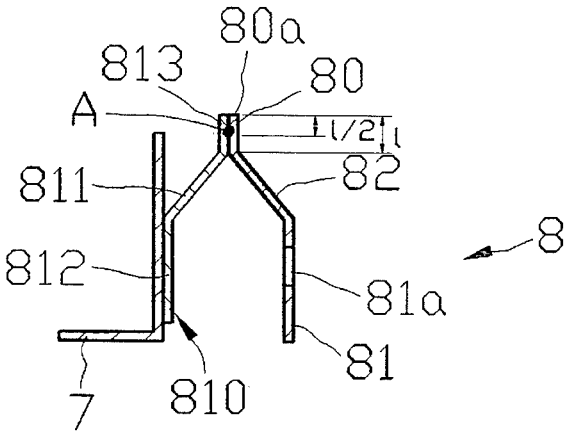
FIG. 7 is a partially enlarged fragmentary sectional view of second embodiment according to the present invention.

In the another embodiment of the present invention shown in FIG. 7, elastic member is formed in two pieces where one piece elastic member is symmetrically welded into another elastic member. Here, the connecting portion 812 is attached to mask frame 7, the fixing portions 813, 80 of each piece one welded into each other, and the welding point is disposed at less than one half of fixing portion's length from top end 80*a* thereof.

This another embodiment of the present invention has same functions and effects as those of first embodiment while specific embodiments of the invention have been illustrated and described wherein, it is to realize that modifications and changes will occur to those skilled in the art.

It is therefore to be understood that the appended claims are intended to cover all modifications and changes which fall within the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An elastic member for supporting a shadow mask of a color picture tube having a panel, comprising:

a fixing portion including a welding point which is located at less than a half of said fixing portion's length from a top end thereof and an extended portion movably extending from said welding point to a bottom end of the fixing portion, said extended portion having a length which is more than a half of said fixing portion's length, said fixing portion being fixed to a mask frame of the color picture tube at said welding point;

a connecting portion having a connecting hole through which said elastic member is attached to a panel pin formed on the inner side of the panel; and a sliding portion which connects said fixing portion and said connecting portion, so as to form a one-piece elastic member;

wherein said extended portion of the fixing portion reduces permanent deformation of the elastic member.

2. The elastic member according to claim 1, wherein said fixing portion includes only one welding point.

3. The elastic member according to claim 1, wherein said fixing portion is fixed to the mask frame of the color picture tube only at said welding point.

4. A two-piece elastic member for supporting a shadow mask of a color picture tube having a panel, comprising:

a first elastic member including:

a connecting portion attached to a mask frame of the color picture tube, a sliding portion which connects said connecting portion and a fixing portion, and said fixing portion having a welding point which is located at less than a half of said fixing portion's length from a top end thereof and an extended portion movably extending from said welding point to a bottom end of the fixing portion, said extended portion having a length which is more than a half of said fixing portion's length; and a second elastic member symmetrically attached to said first elastic member including:

a fixing portion welded to the fixing portion of said first elastic member, a sliding portion, and a connecting portion having a connecting hole through which said second elastic member is attached to a panel pin formed on the inner side of the panel;

wherein said fixing portion of the second elastic member is welded to the fixing portion of the first elastic member at said welding point of the first elastic member, said extended portion of the fixing portion of the first elastic member reducing permanent deformation of the two-piece elastic member.

5. The two-piece elastic member according to claim 4, wherein said fixing portion of the first elastic member has only one welding point.

6. The two-piece elastic member according to claim 4, wherein said fixing portion of the second elastic member is welded to the fixing portion of the first elastic member only at said welding point.

* * * * *